US007799216B2

(12) United States Patent
Gurmu

(10) Patent No.: US 7,799,216 B2
(45) Date of Patent: Sep. 21, 2010

(54) DRAIN TRAP WITH STRAINER AND CUP

(76) Inventor: Michael Gurmu, 507 Forest St., #102, Oakland, CA (US) 94618

( * ) Notice: Subject to any disclaimer, the term of this patent is extended or adjusted under 35 U.S.C. 154(b) by 109 days.

(21) Appl. No.: 12/285,727

(22) Filed: Oct. 14, 2008

(65) Prior Publication Data

US 2009/0045125 A1 Feb. 19, 2009

Related U.S. Application Data

(63) Continuation-in-part of application No. 11/699,626, filed on Jan. 29, 2007, now Pat. No. 7,531,088.

(60) Provisional application No. 60/841,910, filed on Sep. 1, 2006.

(51) Int. Cl.
*B01D 35/02* (2006.01)

(52) U.S. Cl. ..... 210/153; 210/163; 210/305; 210/447; 210/454; 210/463; 4/288; 4/291; 4/292; 4/679; 137/247.51

(58) Field of Classification Search ..... 210/153, 210/163, 299, 305, 312, 443, 446, 447, 454, 210/459, 463; 4/288, 290, 291, 292, 679, 4/681; 137/247.41, 247.51
See application file for complete search history.

(56) References Cited

U.S. PATENT DOCUMENTS

| | | | | |
|---|---|---|---|---|
| 1,217,763 | A | 2/1917 | Hirrich | |
| 1,608,966 | A | 11/1926 | Tanaka | |
| 2,467,547 | A | 4/1949 | Bimbaum | |
| 3,935,602 | A | 2/1976 | Kale | |
| 4,032,455 | A | 6/1977 | Kale | |
| 4,164,048 | A | 8/1979 | Kampfer et al. | |
| 4,179,762 | A | 12/1979 | Barnhardt et al. | |
| 4,230,582 | A | 10/1980 | Tuleja | |
| 4,301,554 | A | 11/1981 | Wojcicki | |
| 4,539,718 | A | 9/1985 | Haer | |
| 4,700,412 | A | 10/1987 | Manuel | |
| 4,949,406 | A | 8/1990 | Canelli | |
| 5,241,979 | A | 9/1993 | Chang | |
| 5,267,361 | A | 12/1993 | Lai | |
| 5,525,215 | A | 6/1996 | Marchionda | |
| 5,638,557 | A | 6/1997 | Lida | |
| 7,531,088 | B2 * | 5/2009 | Gurmu | 210/153 |
| 2006/0265804 | A1 | 11/2006 | Santa Ana | |

* cited by examiner

*Primary Examiner*—Christopher Upton

(57) ABSTRACT

Drain trap assembly for separating sediment from discharged wastewater including a conduit with a first upper inlet portion and a second upper outlet portion. Between the inlet and outlet is located a lower bend portion. Interrupting the lower bend portion is a third conduit portion including a cup closure for sediment accumulation out of the wastewater pathway. Affixed to the cup closure and extending generally upwardly within the assembly and across the wastewater flow is a strainer including at least one plate with through-holes sized to reject particulate sediment and other solids of a predetermined size. Another strainer embodiment includes fibers affixed to the closure and extending across the wastewater flow. A strainer support leg may be concave to guide or deflect sediment-laden wastewater downwardly to the accumulation area and may include at least one wastewater flow aperture. Closure removal automatically withdraws the strainer, offering ready access to accumulated sediment.

4 Claims, 7 Drawing Sheets

DRAIN TRAP WITH STRAINER AND CUP

CROSS REFERENCE TO RELATED APPLICATIONS

The present application is a Continuation-in-Part of patent application Ser. No. 11/699,626 filed Jan. 29, 2007; in turn, entitled to the benefit of Provisional Patent Application Ser. No. 60/841,910 filed Sep. 1, 2006, each of which are incorporated in its entirety herein. All benefits of priority of such patent applications are hereby claimed under 35 USC 120 and 35 USC 119(e), respectively.

STATEMENT REGARDING FEDERALLY SPONSORED RESEARCH OR DEVELOPMENT

Not applicable.

REFERENCE TO SEQUENCE LISTING

Not applicable

REFERENCE TO "MICROFICHE APPENDIX"

Not applicable

BACKGROUND OF THE INVENTION

This invention relates to the field of fluid conduits and plumbing, and more specifically to what is more commonly known as a drain trap assembly. This drain trap assembly may also be known as J-bend or P-trap drain assembly (or similar equivalent terms) and is usually employed in a wastewater drain line. For example, such a drain trap allows water to drain from a kitchen, bath or washroom appliance such as a sink or tub outlet while trapping a relatively small volume of wastewater within a bend portion thereof. The trapped wastewater establishes a temporary liquid barrier preventing toxic gases from traveling from a point downstream of the sink or tub outlet and upwardly through the assembly, subsequently entering into the sink through its outlet. This is not the only function of a drain trap assembly.

These devices may further prevent dogs by trapping and diverting sediment and other solid materials into an accumulation chamber or area. The drain trap, e.g., the J-bend or P-trap, is typically manufactured from either plastic (such as polyvinyl chloride, PVC) or metal (for example aluminum, copper, cast iron and stainless steel). The present invention applies to any such materials and for any other purpose where such a drain trap may be required.

Different types and configurations of drain traps such as J-bends or P-traps with similar functions have been suggested over the years to alleviate the clogging of kitchen, bar, bath, and laundry room sinks or tubs. For example, U.S. Pat. No. 4,179,762 issued to Barnhardt et al. illustrates a modified U-shaped drain assembly with a lateral extension receiving an insertable filtering unit and providing for visual inspection. Cannelli's U.S. Pat. No. 4,949,406 provides a front-mounted filtering unit engaged to a drain assembly, and also providing a window for viewing the internal area of the unit. Both Barnhardt et al. and Canelli are positioned to foster total drain clog.

Manuel's U.S. Pat. No. 4,700,412 discloses a complex universal trap structure including a drain trap and separator having a removable bowl with an open top and a center post extending upwardly through a lid member which closes the bowl in a sealed relation. The U.S. Pat. No. 4,301,554 issued to Wojcicki shows an insertable tray within the bend of a drain assembly; and Kampfer et al., U.S. Pat. No. 4,164,048 illustrates a side entry trap that also promotes total drain clog.

Each of these patented devices provides some means of separating the sediment from the drain discharge to prevent clogging or to catch valuable items. However it can be seen that the sediment accumulation in these units can create a rapid backup resulting in dogging of the waste water. Further, the units do not have an accumulation area positioned out of the way of the wastewater passage line. Moreover, they pose manufacturing challenges that drive high production costs and present operability challenges. Generally speaking, they are not easily hand-operable by unskilled consumers. These issues have prevented these designs from market success.

Thus, all prior drain trap assemblies such as P-traps and J-bends and similar assemblies provided with clean-out holes share a common problem. Specifically, they do not address the issues of clogging, manufacturing difficulty, consumer demands for ease and simplicity of operation, and for reasonable pricing. The present invention addresses and successfully solves these problems. The invention disclosed herein is based on the ideal of preventing problems before they occur. The novel inventive drain trap to be described below will be seen as designed in such a way that it successfully addresses the aforementioned inherent problems of currently available drain traps.

Typically in drain traps (e.g., J-bend or P-trap), sediment accumulates and wears out (or gums up) the assembly parts, thus fostering rust and/or corrosion leading to leaky holes. Due to this wear and tear, the assembly parts degrade considerably and end up having shorter lifespan than expected and desired. Further, an easily accessed inspection hole at a point where debris and sediment (as well as other articles with a wastewater stream are collected or settled) is not to be found on currently available J-bend/P-traps to enable the consumer to readily and periodically clean-out the accumulated material so as to ensure the parts last for their nominal lifespan. Instead, the consumer must call a professional repairperson to fix the problem, usually incurring considerable expense.

Accordingly, it is an object of the present invention to provide a drain trap that readily and effectively separates solid matter from wastewater, while affording constant sediment collection.

It is a further object of the present invention to provide a drain trap that incorporates an accumulation chamber in position to take advantage of gravity and in a location that is easily accessed.

It is also an object of the present invention to provide a strainer configured so as to extend vertically into a lower portion of a drain assembly to filter out dirt, sediment and/or hair, thus preventing these waste impurities or articles inadvertently dropped into a sink or tub from continuing into the drain line or wastewater.

It is a further object of the present invention to provide a cup structure at the bottom or lower portion of the drain trap so as to serve as a solid waste collection and disposal chamber, which cup is manually removable to reveal the service hole, enabling maintenance or servicing of the drain trap.

It is a further object of the present invention to provide a user-friendly inspection/clean-out service hole in the bottom or lower portion of the drain assembly device which can be opened and closed easily by hand.

A further object of the present invention is to enhance productivity and safety on the part of the end-user and/or cleaning staff of organizations or institutions, where applicable.

Finally, it is an object of the present invention to create a drain trap assembly that is fabricated of simple material and with minimal labor, and that easily can be produced and installed in a cost effective manner.

These and other objects of the present invention can be seen in detail by referring to the following specifications and technical drawings.

SUMMARY OF THE INVENTION

In a sink or tub drain line, there is drain trap assembly, for example a J-bend or P-trap or equivalent assembly that retains a water barrier within a bend portion in order to prevent toxic and noxious gas odors from backing (from downstream) through a sink or tub drain and into a living area. This drain trap, while successfully blocking obnoxious gaseous inflows, also is the site of plumbing problems. The trap or bend portion typically clogs when hair, bone, fatty or fibrous substances, dirt or other solid objects pass into, and accumulate therein.

On the other hand, the trap also may capture valuables that inadvertently exit the sink or tub outlet and enter the drainage system. To clear the drain line and remove accumulated material so as to allow free drainage flow and/or recover valuables, the drain trap assemblies of existing technology must be removed by disassembling the trap from the drain and subsequently cleaned. This often is a laborious, time-consuming and costly procedure.

The present invention eliminates the need to remove the drain trap, thus minimizing expense and inconvenience by enabling consumers, themselves, to perform basic preventative maintenance and repairs without need of a professional repairman or special tools. The service hole, being the key to this invention, is built into the very bottom or lower portion of the drain trap, and serves as a solid waste collection chamber incorporating a removable cup with a strainer or barrier that separates solid waste or other objects from the wastewater which then flows through unobstructed.

BRIEF SUMMARY OF THE SEVERAL VIEWS OF THE DRAWINGS

The drawings constitute a part of this specification and include exemplary embodiments to the invention, which may be embodied in various forms. It is to be understood that the invention is not presented to scale and in some instances various aspects of the invention may be shown exaggerated or enlarged to facilitate an understanding of the invention. For a more comprehensive understanding of the invention, reference should be made to the accompanying illustrations as follows.

REFERENCE NUMERALS

Figure 1:
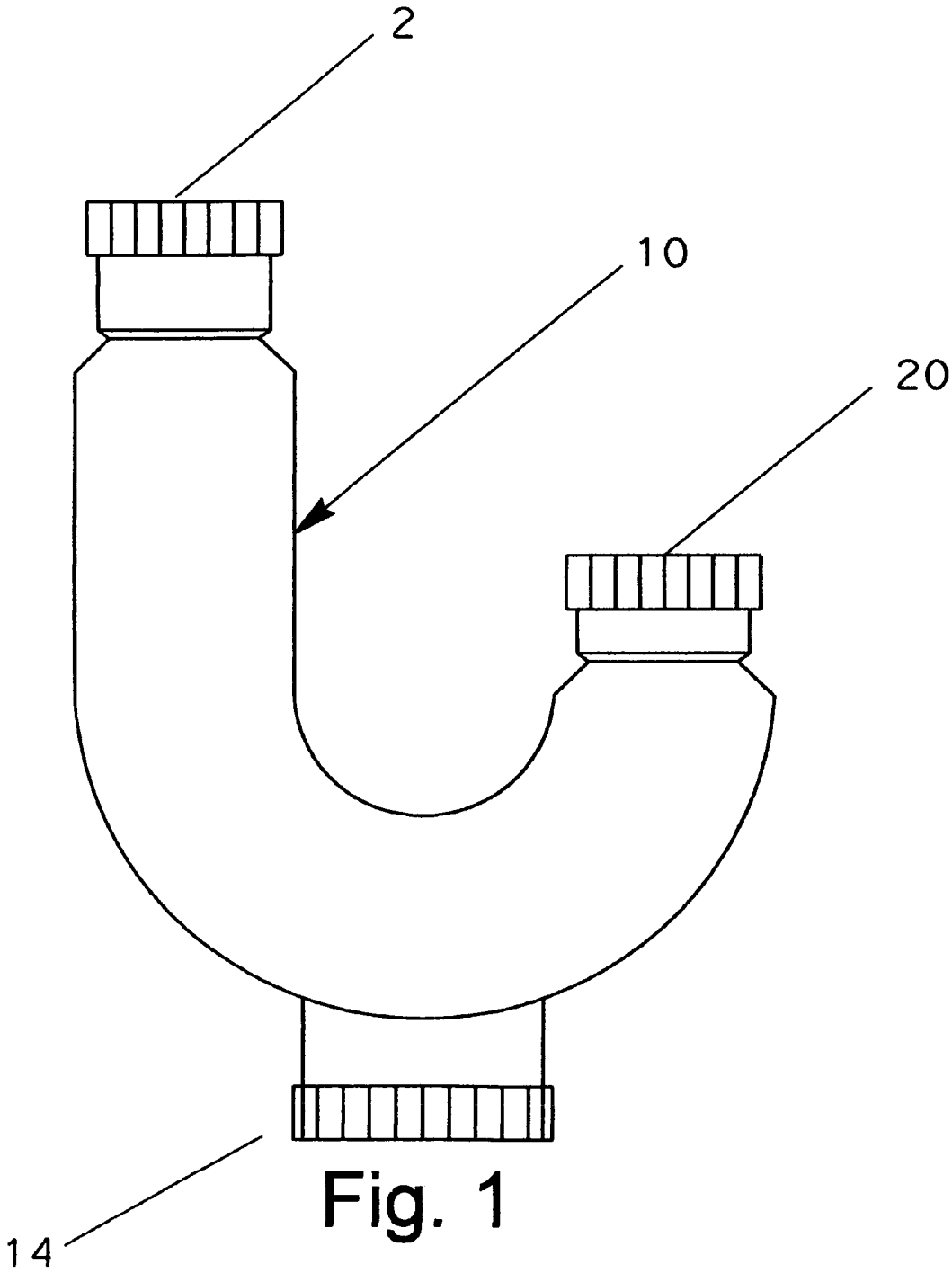
FIG. 1 presents a first side elevation of the drain trap assembly of the present invention with its accumulation chamber.

The following listing associates specific parts with reference characters:

(2) inlet for wastewater from sink;
(4) upper surface of drain trap assembly;
(6) bottom surface of the drain trap assembly;
(7) lateral surface(s) of the drain trap assembly;
(8) accumulation chamber for sediment and solid matter;
(12) gasket (for leakage control);
(14) cup or plug;
(14*a*) cup axis;
(16) filter/strainer leg;
(16*c*) concave or angularly diverting filter/strainer leg;
(18) filter/strainer;
(18*p*) filter/strainer plate
(19) filter/strainer passages;
(20) outlet for wastewater to sewer line;
(22) inspection/clean-out service opening;
(24) upper extent of the strainer;
(26) sediment/solid matter/hair and the like;
(28) wastewater flow direction;
(38) fiber filter/strainer
(38*b*) unitary fiber support base
(38*f*) fiber filter/strainer array
(40) filter/strainer leg apertures

DETAILED DESCRIPTION OF THE INVENTION

The overall drain trap assembly of the present invention is illustrated in FIGS. 1, 2, 3 and 6. It is to be understood, however, that the present invention may be embodied in various forms. FIG. 1 is a first side elevation of the subject invention wherein the assembly is generally identified at 10.

The inventive drain trap 10 is illustrated as including inlet 2 configured to interconnect to the wastewater outlet of an appliance such as a sink or tub, or any fluid flow system that may carry impurities or debris. Further illustrated is an outlet 20 configured to lead or direct wastewater to a sewer line for disposal or to a location where the fluid is required.

Figure 2:
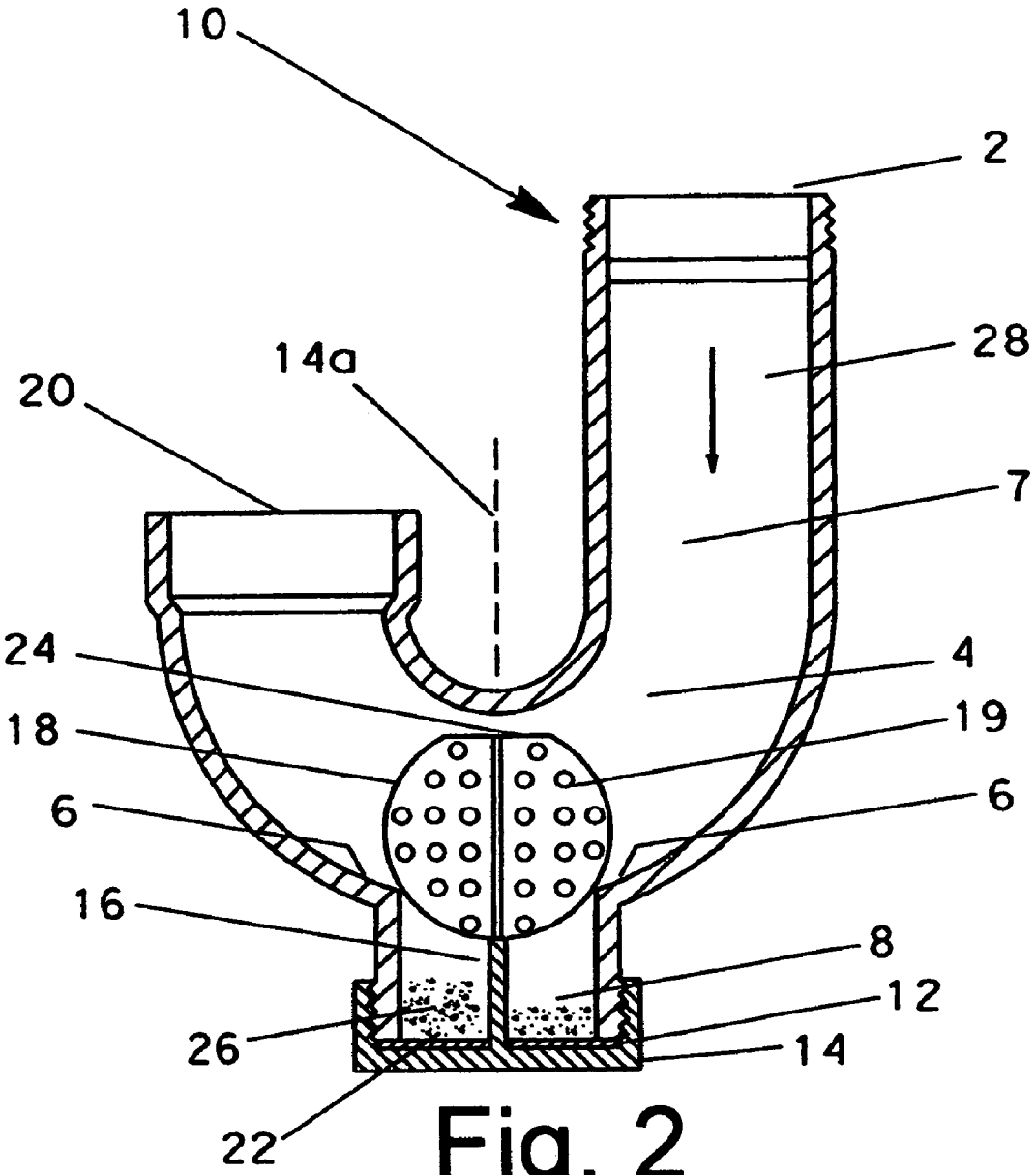
FIG. 2 shows the assembly of FIG. 1 in vertical cross section taken longitudinally of the assembly of FIG. 1 and revealing interior details of the present invention including an internal filter plate element positioned within the assembly.

FIG. 2 shows a sectional view of the drain trap assembly 10 of FIG. 1 revealing the interior of a lateral side thereof. Wastewater, for example, following a flow pathway 28 enters the drain trap assembly 10 at inlet 2 and exits at outlet 20. Along pathway 28, wastewater flows along lower surface 6 and below upper surface 4 of the drain trap 10.

Further illustrated is a collection area or zone for, as an example, sediment 26 interrupting lower surface 6 to form a lower sediment accumulation area 8. Closing the sediment accumulation area 8 is a threaded cup closure 14 configured to engage complementary threaded service opening 22. Within cup closure 14 is a leakage-preventing gasket 12, and filter strainer 18 as will now be described. It should be understood that while connections are noted as threaded, other equivalent interconnections could suffice, as well. Further, it is again noted that this strainer system may find application in fluid treatment systems or flows other than sink/tub drains of the type described only as an example.

The internal surface of cup closure 14 supports a generally upwardly extending filter strainer 18 mounted on a strainer leg 16. Strainer 18 extends along a generally vertical cup closure axis 14*a* directly across the wastewater flow pathway 28. The filter strainer 18 and strainer leg 16 are attached to, or integral with, cup closure 14. This enables the strainer 18 to extend automatically into the wastewater pathway as the closure 14 is threaded or otherwise fastened onto a lowermost surface of drain trap assembly 10 thereby closing service opening 22. Wastewater from the sink or tub flowing into inlet 2 travels downwardly, guided by lower and side surfaces 6 and 7 of assembly 10 where the wastewater impinges against strainer 18.

When cup closure 14 is detached (as, for example, by unscrewing a threaded connection with bottom surface 6), the filter strainer 18 will be withdrawn generally downwardly along with cup closure 14. In this way, sediment 26 including dirt particles, strands or dots of hair and other material entrapped by filter strainer 18 may be removed, and recaptured valuables and other items accidentally included in the wastewater may be recovered.

In a first strainer embodiment a strainer/barrier 18 is fabricated separately or in union with a strainer stand or leg 16 which itself is secured, bonded or integral with closure 14 and/or gasket 12 within cup closure 14. Strainer 18 may be configured to include multiple plate portions, for example at least two strainer plate surfaces 18*p* laterally extending from a central axis 14*a*. Shown in side elevation FIG. 2, front elevation in FIG. 3 and plan view in FIG. 4, for example, are multiple (e.g., four) strainer plate surfaces 18*p* to ensure a more effective straining action. Of course, there may be more or fewer plates as a matter of choice in design.

These strainer plate surfaces just described may be separate elements interconnected at a center strainer axis 14*a*, or may be integrally formed as a unitary element with multiple faces. In any case, strainer 18 is dimensioned so as to extend from adjacent lower surface 6 to adjacent upper surface 4, and further dimensioned to extend adjacent lateral surfaces 7 of drain trap 10. Strainer plate surfaces 18*p* may be pre-formed or trimmed to have generally arcuate edges, as shown for example in FIGS. 2 and 3, suitably conforming to the internal rounded shape commonly found in such a conduit as herein represented by conduit interior surfaces 4, 6 and 7.

The strainer 18, when fully inserted into drain trap 10, extends across the wastewater pathway 28, in such a way as to be directly impinged by the wastewater flow 28. Strainer 18 further includes a number of through-holes or passages 19 of predetermined size permitting wastewater flow, while blocking waste elements of a size greater than said predetermined size of passages 19. Since wastewater flowing along the conduit interior lower and side surfaces generally includes a majority of sediment content (when compared to an upper zone at surface 4), the strainer may be modified as shown so as to permit some overflow. Accordingly, strainer 18 may be chamfered or otherwise foreshortened at its upper extremity or top 24 to permit wastewater that is less sediment-laden to flow freely.

When in position within the assembly 10, the chamfered top 24 will thus be spaced slightly below upper surface 4, thus permitting a portion wastewater flow to pass unrestrained above strainer 18. It will be appreciated that strainer 18 extends below the level of surface 6 of the drain trap 10 so as to more fully restrict direct flow of wastewater which is most likely to carry sediment and other solids. Sediment 26 conveyed against strainer plate surfaces 18*p* and rejected by through-holes 19, falls or sinks downwardly into storage area 8. There the sediment accumulates until subsequent removal through service opening 22.

Cup 14 is fitted with a leak control gasket 12 to serve as a cover to the inspection/service opening 22 as well as a bottom for the accumulation chamber 8. Importantly, when sediment accumulation becomes significant, wastewater flow 28 above strainer top 24 will be relatively slow, resulting in a slowed drainage from the sink or tub. This will serve as notice to the consumer/user that clean-out of the accumulated sediment is due.

Clearing of the sediment is achieved manually by unscrewing (or otherwise removing) cup 14 with its attached or integral strainer 18 to reveal the service opening. Contents may be emptied into a bucket or other container and subsequently disposed. Once cleaned out, the service opening can be closed and the strainer repositioned by simply replacing the cup 14.

Figure 5:
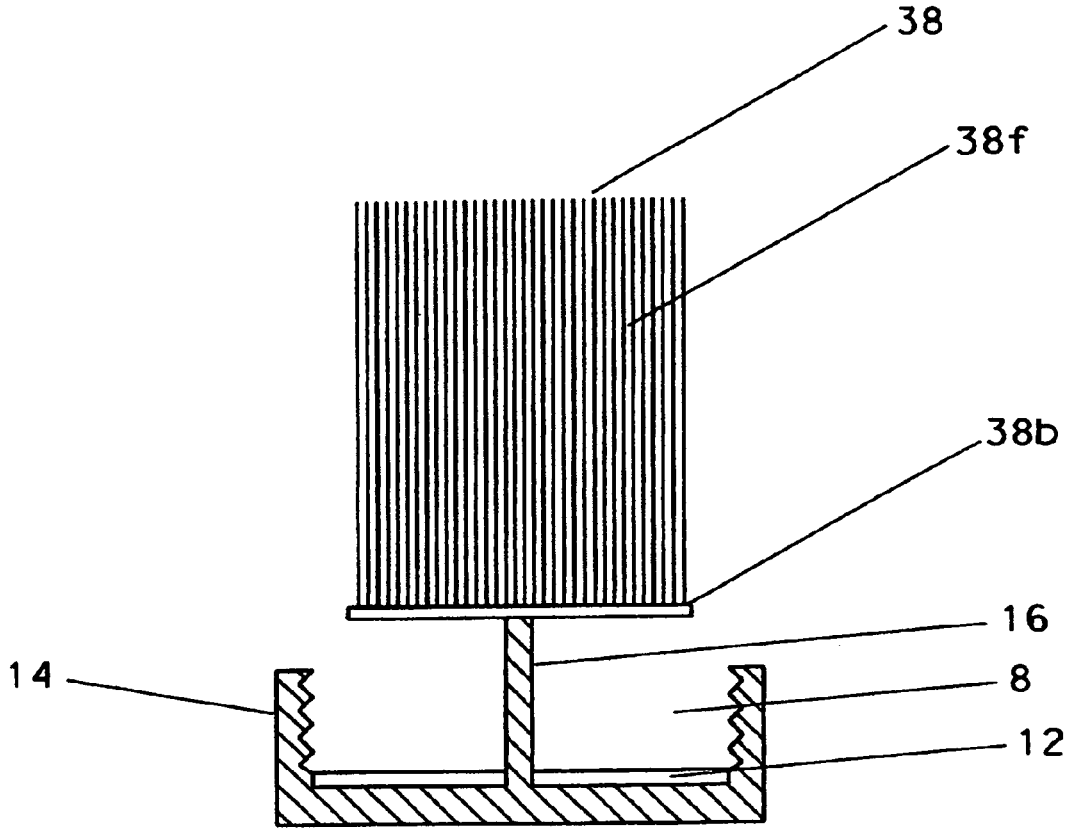
FIG. 5 is an alternative internal filter or strainer element embodiment with an assembly cup and strainer support leg viewed in cross section for clarity and removed from the drain trap assembly.

In a second embodiment of the present invention, as illustrated in FIG. 5, strainer 38 is modified to take the form of a collection or mass of solid strands or fibers 38*f* of synthetic or natural materials. These fibers 38*f* are attached to, or formed integrally with fiber support base 38*b* interconnected through filter leg 16 to closure cup 14 and its internal gasket 12. The multiple fiber strainer 38 extends in mass generally upwardly and generally parallel to cup closure axis 14*a*, past the opening in lower surface 6 and to a point adjacent, yet slightly spaced from, interior upper surface 4 so as to present multiple straining fibers to the wastewater flow 28.

The fibers 38*f* are substantially rigid in their individual structures and extend almost to the conduit interior upper surface 4 to engage wastewater flow 28 through assembly 10 from inlet 2 to outlet 20. However, a relatively small flow space remains thereabove for unimpeded flow of less sediment-laden portion of wastewater over the filter and along the upper drain wall surface 4. These fibers 38*f* are configured to strain or separate out the sediment 26 and other solids deposited therebelow into a collection chamber 8 as the wastewater flows toward outlet 20 and subsequently toward the sewer (not shown). Cup 14, of course, is removable along with the strainer as described hereabove so as to facilitate cleaning out the chamber 8.

Figure 6:
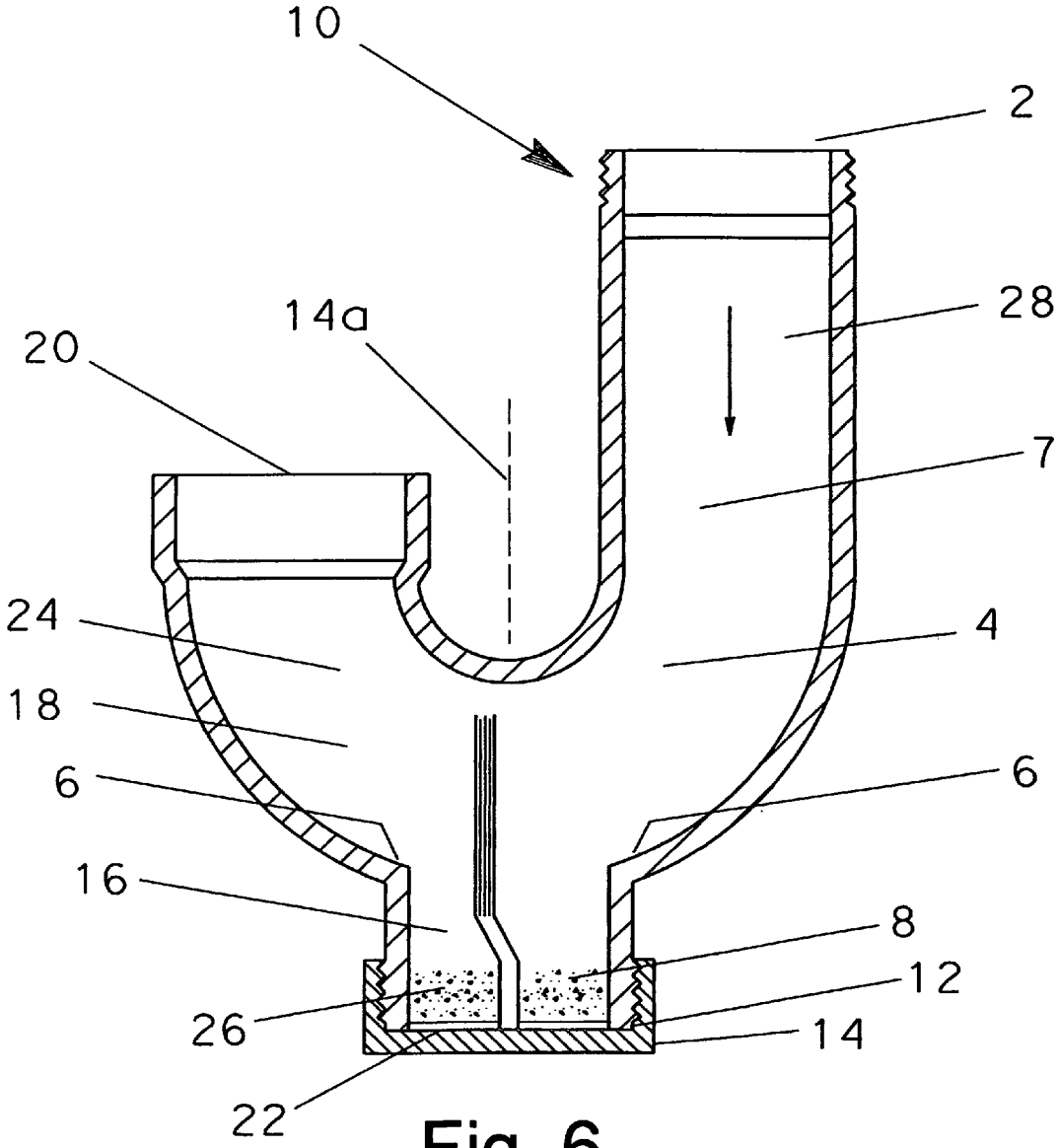
FIG. 6 represents a further alternative internal filter or strainer embodiment illustrating the filter/strainer positioned within a cross-sectional view of the drain trap assembly.
Figure 7:
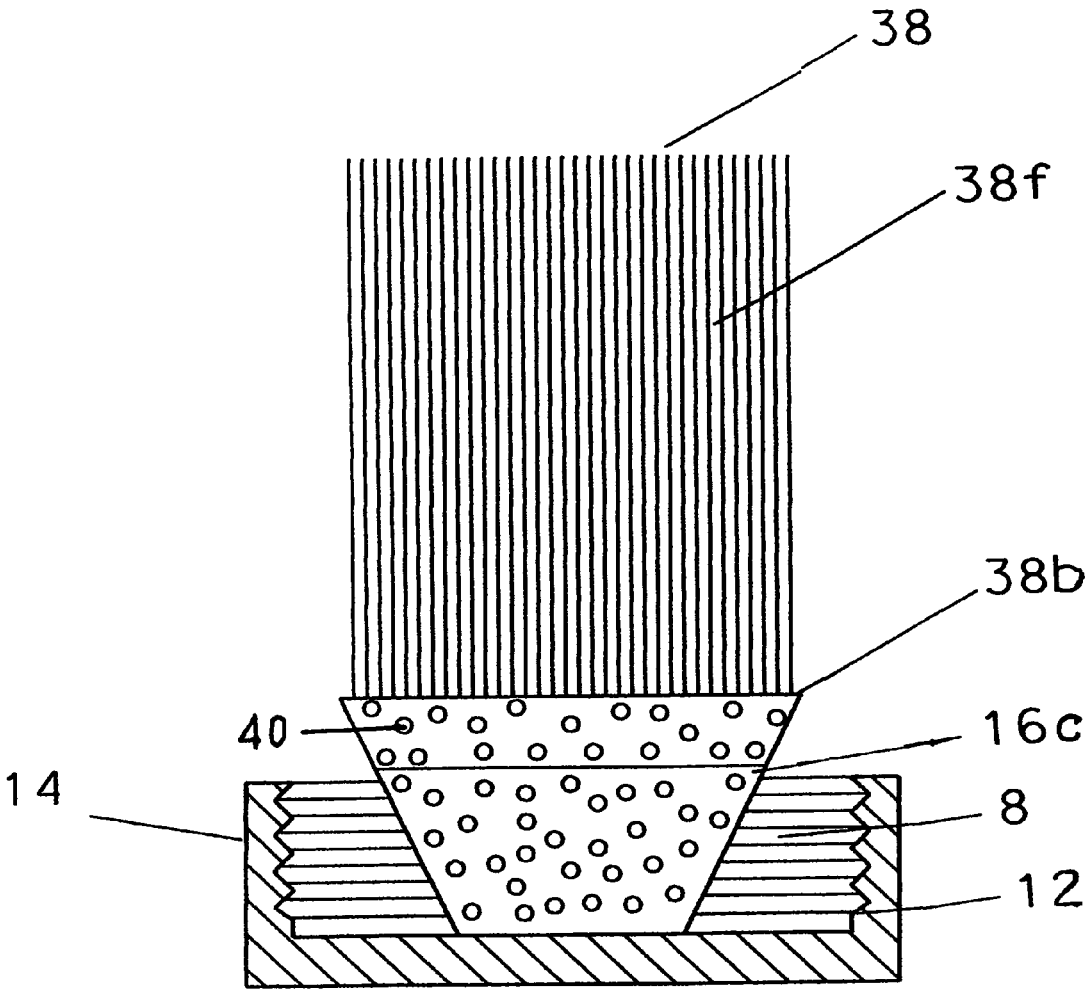
FIG. 7 is a front elevation of the further alternative internal filter or strainer embodiment of FIG. 6 wherein the filter/strainer is mounted in an assembly cup (illustrated in cross section for clarity) withdrawn from the drain trap assembly.

In the embodiment illustrated in FIGS. 6 and 7, fiber strainer 38 and its upwardly extended fibers 38*f* are attached to (or integral with) leg 16*c* illustrated in this view as having a concave surface presentation to be directly engaged by wastewater flow 28. Concave or angular leg 16*c* reaches across the conduit generally the same extent as does the mass of upwardly extended fibers.

As wastewater laden with sediment impacts the mass of fibers 38*f*, at least a portion of the wastewater flow is diverted downwardly toward a sediment accumulation area at cup 14. Thus, heavier, suspended particles are deflected or diverted by the concave surface of leg 16*c* toward collection chamber 8 where they settle into the cup 14 for subsequent removal.

Again, fluid which is less solid-laden overflows fibers 38*f* adjacent upper surface 4, passing directly toward outlet 20. Fluid carrying larger solids directly engage fibers 38*f* where the larger solids remain on an upstream side of the filter fibers 38*f*. Still larger solids are drawn by gravity and/or diverted by fluid impingement against the angular or concave upstream surface of support leg 16*c*. Thus, the larger solids are diverted or directed so as to descend downwardly to said collection chamber 8. Apertures 40 defined along the surface of concave support leg 16*c* permit fluid passage from an upstream to downstream side of filter fibers 38*f*.

Figure 3:
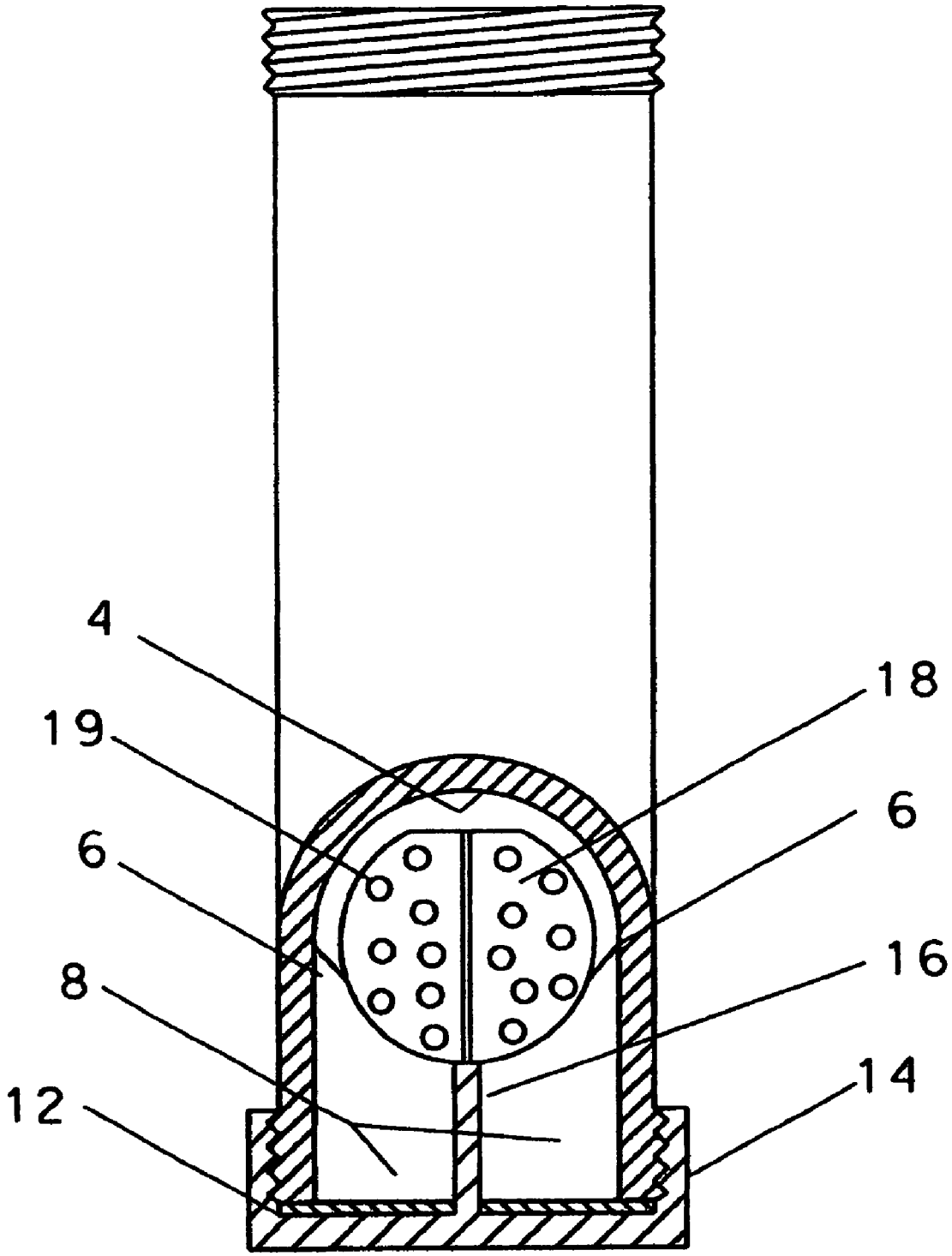
FIG. 3 is a partial lateral cross sectional view of the interior of the drain trap assembly FIG. 2, and illustrating further details of the internal plate filter or strainer of the present invention.
Figure 4:
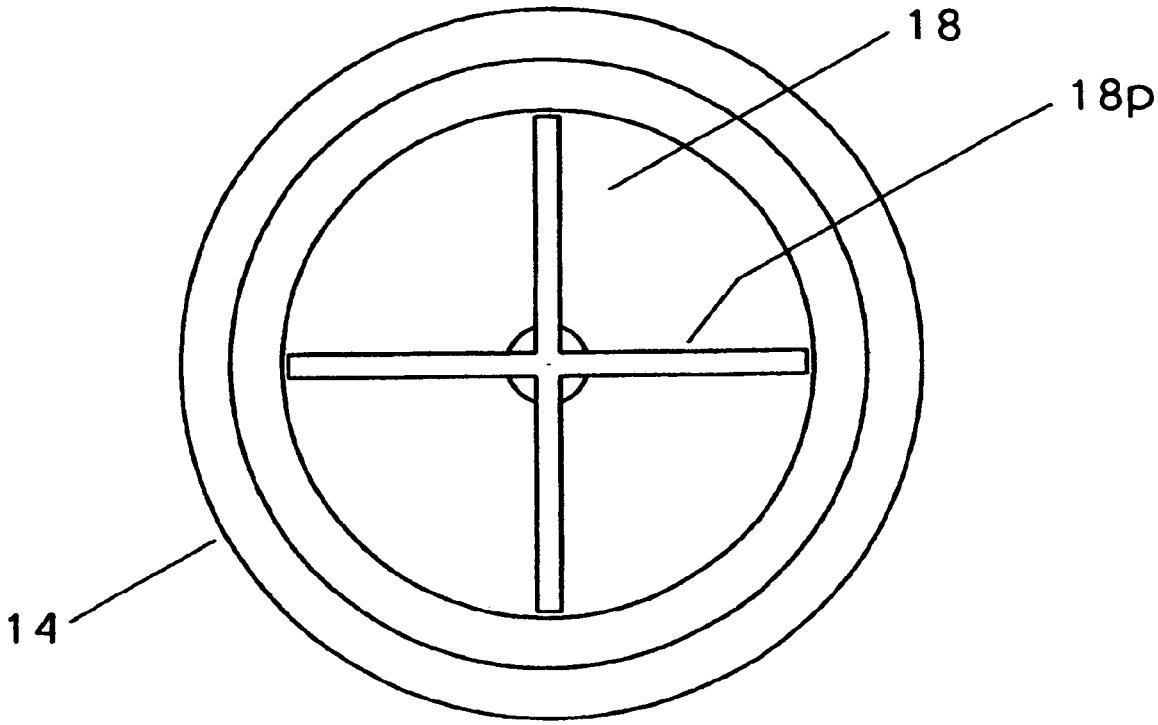
FIG. 4 illustrates a plan view of the internal filter plate filter or strainer element illustrated in FIG. 3, shown here as removed from the drain trap assembly.

The broad concave or angular support leg 16*c* is not limited to the fiber filter 38*f* embodiment since it may just as well be incorporated as a filter support leg for the upwardly extending strainer/filter configurations illustrated in FIGS. 2 and 3. Similarly, the embodiment illustrated in FIGS. 6 and 7 may incorporate therein the disc shaped filter 18 introduced in FIGS. 2 and 3. Current illustrations should be considered adequate disclosure of these latter embodiments.

It should be evident that the inventive device disclosed herein may be fabricated or formed in a variety of ways and from a variety of materials. The various pars may be machined, molded or otherwise fabricated from plastic (e.g., PVC) or metal, or be manufactured from a combination of any suitable materials and processes. The choice of materials and construction are clearly within the scope of the appended claims.

From the present disclosure, it will be seen that this invention in its various embodiments provides a useful assembly that will serve to separate sediment from wastewater flowing out of a sink or similar outlet, to prevent clogging and/or loss of valuables caught up in the wastewater. This device offers a new and unique assembly, one that is simple to manufacture and easily serviced by the untrained consumer.

Upon carefully reviewing the foregoing specification along with the accompanying drawings it will be evident that this invention is susceptible of modifications, combinations, and alterations in a number of ways which may differ from those set forth. Accordingly, the following claims are intended to cover all such modifications which do not depart from the spirit and scope of the invention.

I claim:

1. A drain trap assembly for collecting sediment from wastewater flowing from an appliance drain to a sewer line, said drain trap assembly characterized as including:

a conduit having a first upper conduit portion defining therein a first opening configured for appliance drain interconnection, and a second upper conduit portion spaced from said first upper conduit portion and defining therein a second opening configured for sewer line interconnection;

said conduit further including upper, lower and side surfaces defining an interior wastewater flow pathway from said first opening to said second opening;

said drain trap assembly further including a third conduit portion defining a lower access opening generally below and between said first and second upper conduit portions;

a removable cup closure engaged to said third conduit portion so as to temporarily close said lower access opening;

said cup closure further defining a sediment accumulation area within said third conduit portion;

said cup closure further including a strainer removably extended within said drain trap assembly generally upwardly from said lower conduit surface area and across said wastewater pathway to a point at least adjacent said upper conduit surface area;

said closure cup has a generally vertical cup axis when engaged with said third conduit portion;

said strainer comprises multiple fibers extending in mass generally upwardly from said cup and generally parallel to said cup axis so as to present multiple straining fibers to said wastewater flow;

said multiple fibers are attached to a unitary fiber support base which in turn is attached through a strainer support leg to said closure cup at said sediment accumulation area such that said strainer and cup are conveniently removed as said closure is opened;

said strainer support leg extends across said wastewater pathway along with said upwardly extending multiple fibers;

said strainer support leg having a generally concave surface at an upstream side of said multiple fibers for diverting at least some of said wastewater and sediment downwardly toward said sediment accumulation area;

said strainer support leg having at least one aperture defined therein for passage of said wastewater from an upstream side of the strainer to a downstream side of said strainer;

whereby said strainer engages sediment in said wastewater such that said sediment is guided by said generally angular concave leg surface to descend to said collection area for subsequent removal and disposal by removal of said cup closure.

2. The drain trap assembly of claim 1 further characterized by:

said strainer is attached through said strainer support leg to said closure cup at said sediment accumulation area;

whereby said strainer and closure cup are conveniently removed as said closure is opened.

3. The drain trap assembly of claim 1 further characterized by:

said multiple fibers extend to a point that is slightly spaced from said conduit interior upper surface;

whereby wastewater that is less sediment-laden is permitted to flow freely over said strainer.

4. A cup closure for a wastewater conduit drain trap assembly wherein said cup closure includes:

a removable attachment configuration so as to temporarily dose said drain trap assembly;

said cup closure further defining a sediment accumulation area therein;

said cup closure further including a support leg within said accumulation area;

said support leg extends across said sediment accumulation area and includes a generally concave upstream surface for guiding at least a portion of said wastewater to said sediment accumulation area;

said support leg having at least one aperture defined therein for passage of said wastewater from said sediment accumulation area;

attached to said support leg and extending along a generally central cup closure axis and away from said accumulation area is a strainer;

said strainer comprises multiple fibers extending in mass generally away from said cup and each generally parallel to said cup closure axis so as to present multiple straining fibers to said wastewater flow when said cup closure is attached to said drain trap;

whereby said strainer and closure cup are conveniently removed as a unit as said cup closure is removed to open said drain trap.

* * * * *